United States Patent [19]

Wilson et al.

[11] 4,138,227

[45] Feb. 6, 1979

[54] PRODUCTION OF LOW POUR, LOW SULFUR FUEL OILS

[75] Inventors: Raymond F. Wilson; Reese A. Peck, both of Fishkill; Sheldon Herbstman, Spring Valley; Li C. Mih, Wappingers Falls, all of N.Y.

[73] Assignee: Texaco Inc., New York, N.Y.

[21] Appl. No.: 865,104

[22] Filed: Dec. 27, 1977

Related U.S. Application Data

[63] Continuation of Ser. No. 736,625, Oct. 28, 1976, abandoned, which is a continuation of Ser. No. 537,032, Dec. 27, 1974, abandoned.

[51] Int. Cl.[2] ..... C10L 1/18

[52] U.S. Cl. ..... 44/62; 208/67

[58] Field of Search ..... 44/62; 208/67, 106

[56] References Cited

U.S. PATENT DOCUMENTS

| | | | |
|---|---|---|---|
| 3,738,931 | 6/1973 | Frankovich et al. | 208/67 |
| 3,767,564 | 10/1973 | Youngblood et al. | 208/106 |
| 3,792,984 | 2/1974 | Cole et al. | 44/62 |

*Primary Examiner*—Winston A. Douglas
*Assistant Examiner*—Mrs. Y. Harris-Smith
*Attorney, Agent, or Firm*—Thomas H. Whaley; Carl G. Ries; Robert Knox, Jr.

[57] ABSTRACT

Low pour, low sulfur fuel oils are prepared by thermally cracking a high sulfur, high pour point atmospheric residuum and blending the product with a high wax, low sulfur, high pour point atmospheric residuum. The pour point may be lowered further by the addition of a pour point depressant.

6 Claims, No Drawings

PRODUCTION OF LOW POUR, LOW SULFUR FUEL OILS

This is a continuation of application Ser. No. 736,625 filed Oct. 28, 1976, now abandoned, which, in turn, is a continuation of application Ser. No. 537,032 filed Dec. 27, 1974, now abandoned.

This invention relates to the production of residual fuels of improved pour points. More particularly, it is concerned with the production of blends of residual fuels having both low pour points and low sulfur content.

In the refining of petroleum, the crude oil is first distilled under atmospheric pressure and the lighter distillates such as naphtha and kerosene are used in the production of motor fuels and jet fuels. Higher boiling distillates such as gas oils are generally subjected to catalytic cracking for conversion into gasoline blending components. Heavier residue-containing materials are frequently used as industrial fuels.

Two types of crude oils are high sulfur, high pour crude oils and high pour waxy, low sulfur crude oils. Unfortunately the residual products recovered from the distillation of these crude oils have high pour points due either to the high viscosity of the residuum or its high wax content. These residual oils generally have pour points of at least 90° F. and on occasion over 100° F.

It has been proposed to reduce the pour point of highly viscous residua by the addition thereto of low pour point cutter oil. However, this is unsatisfactory as the low pour point cutter oil can be used in the production of more valuable products. It has also been proposed to reduce the pour point of high wax content residua by solvent extraction at low temperatures but the attendant expense of removing the wax from the crude oil and recovering the solvent renders this procedure uneconomic. Centrifugation of high wax oils has also been proposed but this is unsatisfactory from a commercial standpoint.

It is therefore an object of this invention to produce residual fuels of improved pour point. Another object of the invention is to produce a residual fuel of low pour point by blending residua obtained from a waxy, low sulfur, high pour crude oil and a high sulfur, high pour crude oil. These and other objects of the invention will be apparent to those skilled in the art from the following disclosure.

According to our invention, there is provided a process for the production of a residual fuel oil of improved pour point which comprises subjecting a high sulfur, high pour point atmospheric residuum to thermal cracking and forming a residual fuel blend containing from 30 to 70 weight % of said thermally cracked product and from 70 to 30 weight % of a high wax, low sulfur, high pour point atmospheric residuum and also containing from 0.05 to 1.0 weight % pour point depressant. In a more specific embodiment, a residual fuel oil of improved pour point and reduced sulfur content is prepared by subjecting a high sulfur, high pour point atmospheric residuum to thermal cracking, separating the thermally cracked product into a vacuum gas oil and a vacuum residuum, subjecting the vacuum gas oil to catalytic hydrogenation, blending the hydrogenated oil with the vacuum residuum and the high wax, low sulfur, high pour atmospheric residuum and adding from 0.05 to 1.0 % by weight of a pour point depressant.

The waxy crude oil used in the production of the high wax, low sulfur, high pour atmospheric residuum typically has an API gravity of about 30 to 70°, a sulfur content between about 0.1 and 2.0 wt. %, a Saybolt viscosity at 100° F. of about 20 to 100 SUS, a wax content of between about 3 and 20 wt. % and a pour point between about 60 and 100° F. An example of a waxy, high pour, low sulfur crude which can be used to provide one of the starting ingredients of the present invention is known as Amna crude which has an API gravity of about 35°, a Saybolt viscosity of about 70 SUS at 100° F., a pour point of about +70° F., a wax content of about 14% and a sulfur content of about 0.2 wt. %. Distillation of the crude at atmospheric pressure to remove materials boiling up to about 650° F. results in a residue generally having a pour point of about 100° F. or higher, a sulfur content of about 0.3 wt. % and a wax content of about 25 wt. %.

Crude oils which may be used in the production of the high sulfur, high pour atmospheric residuum used in our process typically have an API gravity of about 25 to 35°, a sulfur content between about 2.5 and 4.5 wt. %, a Saybolt viscosity at 100° F. of about 50 to 100 SUS, a wax content of between about 2 and 7 wt. % and a pour point between +5 and +25° F. A suitable crude from which may be derived a high pour, high sulfur atmospheric residuum is Arabian crude or Lago Medio crude. Removal of the materials boiling below about 650° F. at atmospheric pressure from this crude will leave an atmospheric residuum generally having an API gravity of about 14°, a Saybolt viscosity of about 345 SUS at 100° F. a pour point of about +60° F., a sulfur content of about 3.5 wt.%, a carbon residue of about 10 to 12 wt. % and an asphaltene content between about 3 and 7 wt. %.

The pour point depressant additives suitable for use in the process of our invention preferably comprise oil-soluble ethylene-unsaturated aliphatic monocarboxylic acid ester copolymers in which the monocarboxylic acid component of the ester contains from 2 to about 6 carbon atoms, the copolymers having an average molecular weight of about 17,000 to about 30,000 as determined by the membrane osmometry method, a vinyl ester content of from about 10 to about 45% and a melt index of from about 7 to about 476. The preferred copolymers are sold under the trade name of "Elvax" by E. I. du Pont de Nemours and Co., the most preferred being "Elvax 250" which contains from about 27 to 29% vinyl acetate and a melt index of 12–18 as determined by ASTM 1328. The pour point depressant is present in the final blend in an amount between 0.05 and 1.0% by weight, preferably between 0.1 and 0.5 weight %.

With respect to the atmospheric residua used in the process of our invention, the term "high sulfur" means a sulfur content of at least 2.0 wt. %, the term "high wax" is defined as a wax content in excess of 10 wt. %, "high pour" is defined as a pour point of at least 75° F. and "low sulfur" means a sulfur content not greater than 1.0 wt. %.

The thermal treatment to which the high pour, high sulfur, atmospheric residuum is subjected may be carried out at a temperature between about 600 and 1000° F., preferably between 750 and 950° F. The pressure may range between 0 and 2000 psig and the residence time between about 5 minutes and 5 hours, the time at any particular temperature being selected to obtain a conversion of from about 10 to 20 wt. % of the charge to materials boiling below the initial boiling point of the charge. The thermal treatment may be carried out as a batch process although a continuous process is preferred. In the latter case, advantageously the atmospheric residuum charge is passed downwardly, for the most part in liquid phase, through a bed of inert particulate contact material such as Berl saddles. It is also possible to carry out the thermal treatment in an elongated tubular reaction vessel through which the oil is passed under conditions of highly turbulent flow. If desired, hydrogen may be present during the thermal treatment in which case it is added to the oil at a rate between about 200 and 6000 scfb. When hydrogen is added, the pressure in the reaction zone containing the inert packing or in the unpacked elongated tubular reaction zone may range from about 100 to 5000 psig preferably between 500 and 2500 psig.

If it is desired to produce a residual fuel of reduced sulfur content, the thermally treated product may be subjected to vacuum distillation to remove as overhead that fraction boiling up to about 1000° F. ± 50° F. The removed vacuum gas oil is then subjected to catalytic hydrogenation for the conversion of sulfur in the sulfur-containing organic compounds in the oil to $H_2S$.

The catalyst used in the hydrogenation reactor should have good hydrogenation activity but not necessarily have any cracking activity. Suitable catalysts comprise Group VIII metals or compounds thereof used in conjunction with Group VI metals or compounds thereof supported on an inert refractory inorganic oxide. Suitable hydrogenating metals are cobalt, nickel and iron used in conjunction with molybdenum and tungsten preferably in the form of the oxide or sulfide. The Group VIII metal should be present in the catalyst in an amount between about 1 and 5% and if present the Group VI metal may be present in an amount between about 5 and 35% by weight of the catalyst composite. Particularly suitable combinations are nickel-tungsten, nickel-molybdenum and cobalt-molybdenum. The support may be composed of alumina, silica, zirconia, magnesia, beryllia and the like or may comprise a crystalline alumino-silicate not necessarily of reduced alkali metal content and mixtures thereof. A suitable support comprises for the most part, alumina containing a stabilizing amount, e.g., 0.5 to 10 wt. % silica.

Reaction conditions in the hydrogenation zone include a temperature between about 500° and 900° F., preferably between 600° and 800° F. and a pressure of 100 to 3000 psig with a pressure of 400 to 2000 psig being preferred. Space velocities of 0.2 to 5.0 volumes of oil per volume of catalyst per hour may be used with a range of 0.5 to 3.0 being preferred. Hydrogen may be introduced into the hydrogenation zone at a rate between 500 and 5000 scfb preferably at a rate between 700 and 3000 scfb.

Preferably the catalyst is used in the form of a fixed bed of extrudates of cylindrical shape having a maximum dimension of ½ inch. Reactant flow may be upward or downward through the bed or the hydrogen flow may be upward countercurrent to downwardly flowing oil. Preferably the reactant flow is downward.

The hydrogen need not necessarily be pure, satisfactory results having been obtained with hydrogen having a purity as low as 50% although hydrogen having a purity of at least about 70% is preferred. Electrolytic hydrogen, catalytic reformer by-product hydrogen and hydrogen obtained by the partial oxidation of carbonaceous material followed by shift conversion and $CO_2$ removal are satisfactory.

The following examples are submitted for illustrative purposes only.

EXAMPLE I

In this example, an Arabian atmospheric residuum having a sulfur content of 3.1 wt. %, a carbon residue of 10.2 wt. %, an API gravity of 13.4°, an initial boiling point of about 650° F., an asphaltene content of 3.67 wt. % and containing 6.14 wt. % pentane insoluble material is thermally treated by being passed downwardly through a reaction zone containing Berl saddles at a temperature of 825° F., a pressure of 500 psig at a liquid hourly space velocity of 0.5 and in the presence of 2000 standard cubic feet of hydrogen per barrel of oil. Conversion to materials boiling below 650° F. amounted to 12 wt. % of the charge. The thermally cracked product is then separated into a vacuum gas oil having an end boiling point of about 1000° F. amounting to 58 wt. % basic fresh feed and a vacuum residuum having an initial boiling point of about 1000° F. amounting to 42 wt. % basis fresh feed and having a sulfur content of 3.7 wt. %. The vacuum gas oil which has an API gravity of 20.2, a sulfur content of 2.6 wt. %, a carbon residue of 1.29 wt. % and a pour point of 90° F. is subjected to catalytic hydrogenation by being passed downwardly through a reaction zone containing a pelleted catalyst containing 3.0 wt. % cobalt oxide, 15% molybdenum oxide, 3.6% silica and the balance alumina, at a temperature of 700° F., a pressure of 1500 psig, a LHSV of 1.0 in the presence of 7000 SCFB hydrogen. The hydrogenated product has an API gravity of 25.6°, a sulfur content of 0.2 wt. %, a carbon residue of 0.12 wt. % and a pour point of 90° F. The hydrogenated oil is blended with an Amna atmospheric residuum having an initial boiling point of about 650° F., a sulfur content of 0.28 wt. %, a wax content of 22.7 wt. % and a pour point of 100° F. in an amount equal to the amount of Arabian atmospheric residuum charge. The blend has a pour point of 95° F.

Upon the addition of 0.1 wt. % Elvax 250, the pour point is reduced to 55° F.

EXAMPLE II

This example is a substantial duplicate of Example I. However, in this case the vacuum residuum obtained in an amount of 42 wt. % basis fresh feed and having a sulfur content of 3.7 wt. % and a pour point of 105° F. is blended with the hydrogenated vacuum gas oil and the Amna atmospheric residuum and to the blend there is added 0.1 wt. % Elvax 250. The resulting blend has a pour point of 40° F. and a sulfur content of 0.97 wt. %. This indicates that the addition of the vacuum residuum to the fuel blend of Example I results in a fuel oil of even lower pour point despite the fact that the pour point of the vacuum residuum is higher than that of the blend of Amna atmospheric residuum and hydrogenated vacuum gas oil.

EXAMPLE III

This example shows the pour points of blends of various materials. The 650° + Amna listed in Table 1 is an Amna atmospheric residuum. The 650° F. + Arabian is an Arabian atmospheric residuum which has been thermally cracked as described in Example I. Elvax-250, a vinyl acetate-ethylene copolymer containing from about 27–29% vinyl acetate is used as the pour point depressant.

TABLE 1

| | Weight Percent of Composition | | |
|---|---|---|---|
| | 1 | 2 | 3 |
| 650° F. + Amna | 100 | | 50 |
| 650° F. + Arabian | | 100 | 50 |
| Pour Point, ° F. | 110 | 60 | 90 |
| Pour Point, ° F. (0.1 wt. % Elvax) | 110 | 50 | 40 |

These data show the remarkable results of our process in the pour point of composition 3 which is made up of equal amounts of Amna atmospheric residuum and thermally cracked Arabian Atmospheric residuum to which 0.1 wt. % pour point depressant based on the weight of the blend is added.

Various modifications of the invention as hereinbefore set forth may be made without departing from the spirit and scope thereof, and therefore, only such limitations should be made as are indicated in the appended claims.

We claim:

1. A process for the production of a residual petroleum fuel oil blend of improved pour point and reduced sulfur content which comprises subjecting a high sulfur, high pour point atmospheric residuum having a wax content between 0 and 5 weight percent to thermal cracking, separating the thermally cracked product by means of distillation under subatmospheric pressure into a vacuum gas oil having an end point of about 1000° F. and a vacuum residuum, subjecting the vacuum gas oil to catalytic hydrogenation under desulfurization conditions and forming a residual fuel blend containing said vacuum residuum, the hydrogenated vacuum gas oil and from 30 to 70 weight percent based on the weight of the blend of a high wax low sulfur atmospheric residuum having a wax content in excess of 10 weight percent, said blend also containing from 0.05 to 1.0 weight percent pour point depressant.

2. The process of claim 1 in which the pour depressant is an ethylene-vinyl acetate copolymer.

3. The process of claim 1 in which the final blend has a pour point of less than 45° F. and a sulfur content of less than 1.0 wt. %.

4. The process of claim 1 in which the thermal cracking takes place in the presence of added hydrogen.

5. The process of claim 4 in which the reactants are passed through a reaction zone containing an inert packing.

6. The process of claim 4 in which the reactants are passed through an elongated tubular reaction zone under conditions of turbulent flow.

* * * * *